US005147569A

United States Patent [19]

DeRosa et al.

[11] Patent Number: 5,147,569

[45] Date of Patent: Sep. 15, 1992

[54] LUBRICANT ADDITIVE TO ENHANCE ANTI-WEAR, ANTI-OXIDANCY, AND DISPERSANCY THEREOF

[75] Inventors: Thomas F. DeRosa, Passaic, N.J.; Benjamin J. Kaufman, Hopewell Junction; Rosemary J. Jennejahn, Nelsonville, both of N.Y.

[73] Assignee: Texaco Inc., White Plains, N.Y.

[21] Appl. No.: 576,807

[22] Filed: Sep. 4, 1990

[51] Int. Cl.[5] ..... C10M 151/00; C08F 228/06

[52] U.S. Cl. ..... 252/47.5; 252/47.0; 252/402; 252/405; 252/406; 525/256; 525/286; 525/303; 525/331.7; 525/331.8; 525/349

[58] Field of Search ..... 252/47.5, 48.6; 525/256, 286, 303, 331.7, 331.8, 349

[56] References Cited

U.S. PATENT DOCUMENTS 4,790,948 12/1988 Liu et al. ..... 252/47.5
4,826,613 5/1989 Hart et al. ..... 252/48.6
4,885,336 12/1989 Boutni et al. ..... 525/286
4,948,842 8/1990 Olivier ..... 525/286
4,965,111 10/1990 Pratt et al. ..... 525/286

*Primary Examiner*—Ellen McAvoy
*Attorney, Agent, or Firm*—Robert A. Kulason; James J. O'Loughlin; Vincent A. Mallare

[57] ABSTRACT

A polymeric additive prepared from ethylene and at least one ($C_3$-$C_{10}$) alpha-monoolefin and a non-conjugated dienes or triene comprising from about 15 to 80 mole percent of ethylene and from about 20 to 85 mole percent of the ($C_3$-$C_{10}$) alpha-monoolefin and from about 0 to 15 mole percent of the diene or triene. This polymeric substrate has a number average molecular weight ranging from about 5,000 to about 500,000. It is modified by reacting the polymer with an unsaturated epoxide wherein the intermediate graft co- or terpolymer is characterized as having pendant epoxides within the substrate.

Post-reacting this graft co- or terpolymer with 1,3,4-thiadiazine modified with substituted phenols, diaryl amines, or phenophiazines generates a polymeric lubricant additive with enhanced anti-oxidant, dispersant, and anti-wear properties.

11 Claims, No Drawings

LUBRICANT ADDITIVE TO ENHANCE ANTI-WEAR, ANTI-OXIDANCY, AND DISPERSANCY THEREOF

BACKGROUND OF THE INVENTION

This invention relates to lubricant additives and more particularly to a functionalized polymeric lubricant additive which behaves as a viscosity index improver (VII) when added to a lubricating oil. In addition, dissolution of this polymeric additive in lubricating oil imparts oxidative protection, enhanced dispersancy, and anti-wear properties to said lubricant.

DISCLOSURE STATEMENT

U.S. Pat. No. 3,522,180 discloses a method for the preparation of an ethylene-propylene copolymer substrate effective as a viscosity index improver for lubricating oils.

U.S. Pat. No. 4,026,809 discloses graft copolymers of a methacrylate ester and an ethylene-propylene-alkylidene norbornene terpolymer as a viscosity index improver for lubricating oils.

U.S. Pat. No. 4,146,489 discloses a graft copolymer where the polymer backbone is an oil-soluble ethylene-propylene copolymer or an ethylene-propylene-diene modified terpolymer with a graft monomer of 2- or 4-vinylpyridine or N-vinylpyrrolidone to provide a dispersant VI improver for lubricating oils.

U.S. Pat. No. 4,320,019 discloses a multifunctional lubricating additive prepared by the reaction of an interpolymer of ethylene and a $C_3$–$C_8$ alpha-monoolefin with an olefinic carboxylic acid acrylating agent to form an acrylating reaction intermediate which is then reacted with an amine.

U.S. Pat. No. 4,340,689 discloses a process for grafting a functional organic group onto an ethylene-propylene copolymer or an ethylene-propylene-diene terpolymer.

U.S. Pat. No. 4,357,250 discloses a reaction product of a copolymer an olefin carboxylic acid via the "ene" reaction followed by a reaction with a mono-amine mixture.

U.S. Pat. No. 4,780,228 discloses the grafting of a hydrocarbon polymer in the absence of a solvent in the presence of a free radical initiator and a chain-stopped agent followed by a reaction with an amine, polyol or aminoalcohol.

U.S. Pat. No. 4,816,172 discloses the preparation of a polymeric lubricating oil additive that imparts both oxidative protection and enhanced dispersancy to lubricating oils.

U.S. Pat. No. 4,904,403 disclosed a method of preparing anti-wear oligomeric lubricating additives by containing a 1,3,4-thiadiazole nucleus.

The disclosures in the foregoing patents which relate to VI improvers and dispersants for lubricating oils, namely U.S. Pat. Nos. 3,522,180; 4,026,809; 4,146,489; 4,320,019; 4,340,689; 4,357,250; 4,780,689; 4,816,172; and 4,904,403 are incorporated herein by reference.

An objective of this invention is to provide a novel graft copolymer composition that behaves as a viscosity index improver with enhanced anti-oxidancy, dispersancy, and anti-wear properties.

Another object of the invention is to provide a multifunctional lubricant additive effective for imparting anti-oxidancy, dispersancy and anti-wear properties to the lubricating oil composition.

A further object is to provide a novel lubricating oil composition containing the graft copolymer additive of the invention as well as to provide concentrates of the lubricant additive of the present invention.

SUMMARY OF THE INVENTION

The novel reaction product of the invention comprises a chemical modification of an ethylene copolymer or terpolymer of a ($C_3$–$C_{10}$) alpha-monoolefin containing a non-conjugated diene or triene termonomer. More specifically, the lubricant of this invention consists of chemically incorporating glycidyl methacrylate (I)

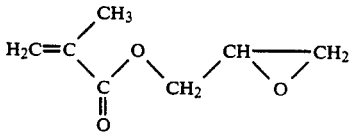

(I)

Glycidyl Methacrylate onto the aforementioned polymeric substrate followed by post-reacting with a nucleoplile. The chosen nucleophiles are those that contain the 1,3,4-thiadiazole nucleus; three strategic materials were determined to be especially effective as anti-wear, anti-oxidants and dispersants. In the first case, nucleophiles consisted of 1,3,4-thiadiazole containing a substituted phenol represented by the formula:

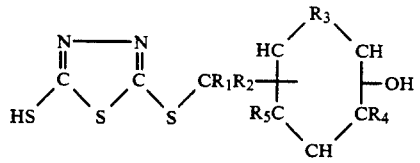

where $R_1$ and $R_2$ or each Hz or a ($C_1$–$C_{10}$) (alkyl radical; and $R_3$, and $R_4$, and $R_5$ are each a ($C_1$–$C_{10}$) alkyl radical containing at least one heteroatom.

Similarly, a second nucleophile containing modified 1,3,4-thiadiazole and a substituted diarylamine represented by the

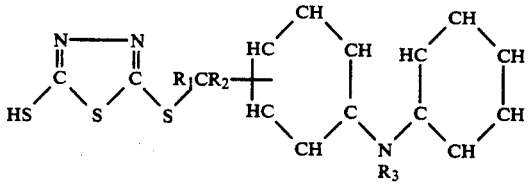

where $R_1$, $R_2$, and $R_3$ are each $H_2$ or a ($C_1$–$C_{10}$) alkyl radical.

A third nucleophile containing modified 1,3,4-thiadiazole and a substituted phenothiazine represented by the formula:

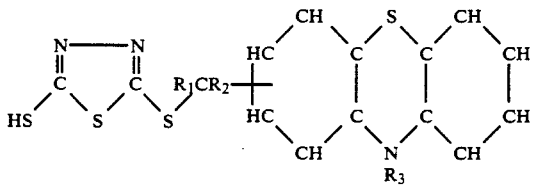

where $R_1$, $R_2$, and $R_3$ each are $H_2$ or a ($C_1$–$C_{10}$) alkyl radical group.

The process of chemically incorporating (II) onto a polymeric substrate circumvents several fundamental problems associated with utilizing modified 1,3,4-thiadiazoles as simple lubricating oil additives.

1. Strategically modified 1,3,4-thiadiazoles have limited solubility in lubricating oils Anti-wear, anti-oxidancy, and dispersancy are optimized only when the strategic material is homogenously dispersed in lubricating oil. Chemically coupling modified 1,3,4-thiadiazoles to oil soluble polymers ensures complete miscibility of the strategic material.

2 Modified 1,3,4-thiadiazoles additives with limited lubricating oil solubility sublime at engine operating temperatures Differential removal of modified 1,3,4-thiadiazoles through material sublimation can be expected to differentially decrease anti-wear, anti- oxidancy, and dispersancy protection. Chemically incorporating modified 1,3,4-thiadiazoles onto polymers having molecular weights of at least 80,000 amu eliminates additive volitility.

3. Direct incorporation of modified 1,3,4-thiadiazoles directly protects the polymer substrate from oxidative degradation Reducing oxidative degradation of the polymer ensures that the viscosity index improving properties are consistently imparted to the lubricating fluid.

The novel lubricant of the invention comprises an oil of lubricating viscosity and an effective amount of this novel reaction product. The lubricating oil will be characterized as behaving as a viscosity index improver with anti-wear, anti-oxidancy, and dispersancy properties.

Concentrates of the reaction product of the invention are also contemplated.

DETAILED DESCRIPTION OF THE INVENTION

The polymer or copolymer substrate employed in the novel additive of the invention may be prepared from ethylene or propylene or it may be prepared from ethylene and a higher olefin with the range of ($C_3$–$C_{10}$) alpha-olefins.

More complex polymer substrates, often designated as interpolymers, may be prepared using a third component. The third component generally used to prepare an interpolymer substrate is a polyene monomer selected from non-conjugated dienes and trienes. The non-conjugated diene component is one having from 5 to 14 carbon atoms in the chain.

Preferably, the diene monmer is characterized by the presence of a vinyl group in its structure and can include cyclic and bicyclo compounds. Representative dienes include 1,4-hexadiene,1,4-cyclohexadiene, dicyclopentadiene, 5-ethylidene-2-norbornene, 5-methylene-2-norborene, 1,5-heptadiene, and 1,6 octadiene.

A mixture of more than one diene can be used in the preparation of the interpolymer. A preferred non-conjugated diene for preparing a terpolymer or interpolymer substrate is 1,4-hexadiene.

The triene component will have at least two non-conjugated double bonds, and up to about 30 carbon atoms in the chain. Typical trienes useful in preparing the interpolymer of the invention are 1-isopropylidene-3a,4,7, 7a-tetrahydroindene, 1-isopropylidenedicyclopentadiene,dehydrosodicyclopentadiene, and 2-(2-methylene-4-methyl-3-pentenyl)-[2.2.] bicyclo-5-heptene.

The polymerization reaction to form the polymer substrate is generally carried out in the presence of a catalyst in a solvent medium.

The polymerization solvent may be any suitable inert organic solvent that is liquid under reactions conditions for solution polymerization of monoolefins which is generally conducted in the presence of a Ziegler-Natta type catalyst.

Examples of satisfactory hydrocarbon solvents include straight chain paraffins having from 5–8 carbon atoms, with hexane being preferred; aromatic hydrocarbons, preferably those having a single benzene nucleus, such as benzene, toluene and the like; and saturated cyclic hydrocarbons having boiling point ranges approximating those of the straight chain paraffinic hydrocarbons and aromatic hydrocarbons described above, are particularly suitable.

The solvent selected may be a mixture of one or more of the foregoing hydrocarbons. It is desirable that the solvent be free of substances that will interfere with the Ziegler-Natta polymerization process.

In a typical preparation of the polymer substrate, hexane is first introduced into a reactor and the temperature in the reactor is raised moderately to about 30° C. Dry propylene is fed to the reactor until the pressure reaches about 40–45 inches of mercury. The pressure is then increased to about 60 inches of mercury and dry ethylene and 5-ethylidene-2-norbornene are fed to the reactor. The monomer feeds are stopped and a mixture of aluminum sesquichloride and vanadium oxytrichloride are added to initiate the polymerization reaction.

Completion of the polymerization reaction is evidenced by a drop in the pressure in the reactor.

Ethylene-propylene or higher alpha monoolefin copolymers may consist of from about 15 to 80 mole percent ethylene and from about 20 to 85 mole percent propylene or higher monoolefin with the preferred mole ratios being from about 45 to 80 mole percent ethylene and from about 20 to 55 mole percent of a ($C_3$–$C_{10}$) alpha monoolefin.

Terpolymer variations of the foregoing polymers may contain from about 0.1 to 10 mole percent of a non-conjugated diene or triene.

The polymer substrate, that is the ethylene copolymer or terpolymer is an oil-soluble, substantially linear, rubbery material having a number average molecular weight from about 5,000 to 500,000 with a preferred number average molecular weight range of 25,000 to 250,000 and a most preferred range from about 50,000 to 150, 000.

The terms polymer and copolymer are used generically to encompass ethylene copolymers, terpolymers or interpolymers. These materials may contain minor amounts of other olefinic monomers so long as their basic characteristics are not materially changed.

Polymer substrates or interpolymers are available commerically. Particularly useful are those containing from about 40 to 60 mole percent ethylene units and about 40 to 60 mole percent propylene units.

Polymer substrates that may be used are those produced and sold by E.I. Dupont deNemours and Company of Wilmington, Delaware under the label of "ORTHOLEUM 2052" and "PL-1256". The former is a terpolymer containing 48 mole percent ethylene units, 48 mole percent propylene units, and 4 mole percent 1,4-hexadiene units and having an overall inherent viscosity of 1.35. The latter is a similar polymer with an inherent viscosity of 1.95. The viscosity average molecular weights are these two materials are on the order of 200,00 and 280,000 amu, respectively.

Modification of this polymeric substrate is desirable since it generates reactive sites amenable to subsequent post-reactions with strategically important monomers. The initial modification is generally referred to as grafting and it may be effected in a number of ways. An essential criterion of this initial polymer modification is that the reacting monomer must contain an unsaturated reactive site that is activated either thermally or by using a free radical initiator. The modification may be performed by a process known as the "ene" reaction or by solution grafting using a free radical initiator. If the latter grafting protocol is utilized an inert solvent is utilized, with hydrocarbons being preferred. Free radical imitators amenable to this process include peroxides, hydroperoxides, and azo compounds, especially those which have a boiling point greater than 100° C and thermally decompose within the grafting temperature range to ensure an adequate supply of free radicals. Representative of these free radical initiators include, but are not limited to, azobutronitrile and 2,5-dimethylhex-3-yne-2,5-bis-t-butyl peroxide. The initiator is used in an amount between 0.005% to 2.0% by weight based on the weight of the reaction mixture. Typically the grafting reaction is performed at an elevated temperature in the range of about 100° C. to 250° C., preferably 120° C. to 190° C., and more preferably at 150° C. to 180° C., i.e., above 160° C.. Ideally, the grafting solvent is similar or identical to that used in the polymerization reaction and typically contains 40 wt % polymer based on the initial total oil solution. Furthermore, to circumvent oxidative degradation of the polymeric substrate, grafting reactions are performed under an inert atmosphere. And, finally, if any component of the grafting procedure is especially volatile, the reaction may be performed in a enclosed vessel under moderate to high pressure using the aforementioned conditions and material requirements. In contrast, however, when the "ene" reaction is utilized as the grafting protocol, the reaction is typically performed without the use of a free radical initiator. Moreover, the reaction may be performed in the absence of any solvent and at elevated pressures to trap volatile components.

Finally, a grafting strategy best characterized as a hybrid of free radical solution grafting and thermal or "ene" reaction grafting is extruder or mastication grafting. In this design the unsaturated monomer or monomers are physically mixed with the polymer, with or without a charge of free radical initiator, and the mixture passed through a single or twin screw extruder at temperatures typically in the range of 150° C. to 400° C.. If a free radical initiator is used, it is to ensure an adequate supply of free radicals; however, in its absence more than one extruder pass may be performed to ensure high grafting levels.

This invention utilizes non-polar copolymers upon which is grafted glycidyl methacrylate as illustrated by the reaction of EQ. 1:

EQ. 1)

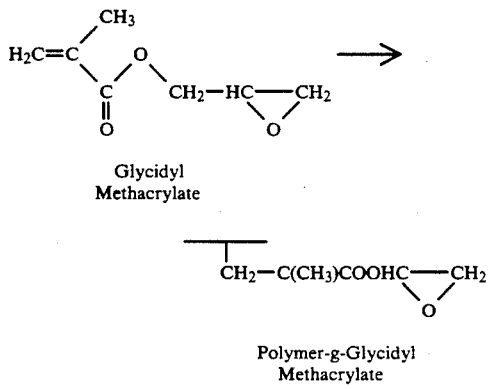

The graft copolymer is then characterized as having reactive epoxide sites contained within an inert hydrocarbon matrix. It is readily apparent that the presence of reactive sites on this graft polymer, viz., epoxides, permits other modifications to be performed that ordinarily would be precluded. More specifically, strategic nucleophiles may be chemically attached to the polymeric substrate utilizing the epoxide reaction site. This is clearly illustrated below in EQ.2. utilizing a mercaptan as a nucleophile:

EQ. 2)

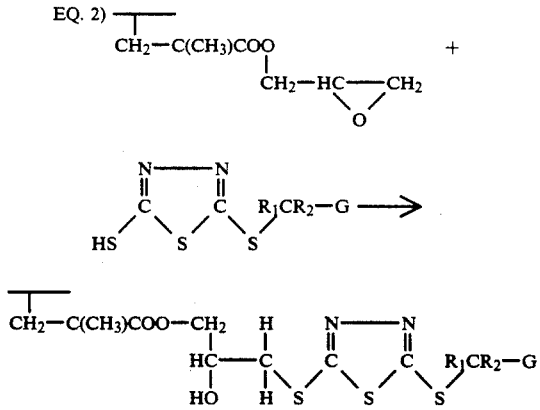

where $R_1$ and $R_2$ are as previously defined and G is representative of a substituted phenol, diarylamine, or a phenothiazine.

The modified graft polymer is characterized as possessing a 1,3,4-thiadiazole nucleus along with strategically attached appendages.

The advantages of the present invention are made the preparation of the novel reaction product additive of the present invention.

EXAMPLE I

Preparation of OCP-g-Glycidyl Metharcylate 60 grams Of ethylene-propylene copolymer (OCP) rubber consisting of about 58 mole percent ethylene and 42 mole percent propylene having a number average molecular weight of 80,000 was dissolved in 485 grams of solvent neutral oil at !60° C. with mechanical stirring while the mixture was maintained under a nitrogen blanket. After the polymer had dissqlved, 5.75 grams of glycidyl methacrylate was added to the mixture along with 0.75 grams of dicumyl peroxide and the mixture heated with strong agitation for an additional 1.75hr to 2.0 hrs. The derivatized graft copolymer was filtered through a 200 mesh filter and the product containing grafted glycidyl methacrylate was isolated and recovered.

EXAMPLE II 110 grams of the aforementioned graft copolymer was heated to 155° C. with strong agitation under a nitrogen blanket and 2.0 g of 2-mercapto-5-mercaptomethyl-[3-(4-hydroxylmethyl-2,6,-di-t-butyl-phenol-)ether]-1,3,4-thiadiazole was added neat to the mixture.

The mixture was heated for an additional 2 hours, passed through a 200 mesh filter, and cooled.

EXAMPLE III

In this example, the same procedure of Example II may be used and 2-mercapto-5-mercaptomethyl-[4-(1,1'diphenylamine)ether]-1,3,4-thiadiazole may be substituted for the thiadiazole therein, and a corresponding glycidyl methacrylate product was isolated and recovered.

EXAMPLE IV

In this example, the same procedure of Example II may be used and 2-mercapto-5-mercapto-i-propyl-[1(phenothiazine) ether]-1,3,4-thiadiazole may be substituted for the thiadiazole therein, and a corresponding glycidyl methacrylate product was isolated and recovered.

EXAMPLE V 70 grams of solid ethylene-propylene copolymer consisting of about 58 mole pecent ethylene and 42 mole percent propylene having a number average molecular weight of 80,000 was dissolved in 530 grams solvent neutral oil at 160° C. with along with strong agitation while under a nitrogen blanket. Following dissolution, 12 g of glycidyl methacrylate was added along with 1.25 g dicumyl peroxide. The material was heated for an additional 2.0 hours and 14.0 g of 2-mercapto-5-mercaptomethyl-[3-(4-hydroxylmethyl-2,6-di-t-butyl-phenol)ether]-1,3,4-thiadiazole added neat and the mixture heated for an additional 2 hours. The mixture was filtered hot through a 200 mesh filter and the product glycidyl methacrylate was isolated and recovered.

EXAMPLE VI

In this example, the same procedure of Example II may be followed and an equimolar amount of 2-mercapto-5-mercaptomethyl-[4-(1,1'-diphenylamine)ether]-1,3,4-thiadiazole may be substituted for the thiadiazole therein and a corresponding methacrylate product was isolated and recovered.

EXAMPLE VII

In this example, the same procedure of Example II may be followed and an equimolar amount of 2-mercapto-5-mercapto-i-propyl-[1-(phenothiazine)ether]-1,3,4-thiadiazole may be substituted for the thiadiazole therein and a corresponding methacrylate product was isolated and recovered.

The novel graft and derivatized polymer of the invention is useful as a polymeric additive for lubricating oils. They are multifunctional additives for lubricants being effective as viscosity index improver that impart enhanced anti-wear, anti-oxidancy, and dispersancy properties of natural and synthetic lubricating oils and mixtures thereof. This novel polymeric additive can be employed in crankcase lubricating oils for spark-ignited and compression-ignited internal combustion engines. The compositions can also be used in gas engines, or turbines, automatic transmission fluids, gear lubricants, metal-working lubricants hydraulic fluids, and other lubricating oil and grease compositions. Their use in motor fuel compositions is also contemplated.

The base oil may be a natural oil including liquid petroleum oils and solvent-treated or acid-treated mineral lubricating oils of the paraffinic, naphthenic and mixed paraffinic-naphthenic types.

In general, the lubricating oil composition of the invention will contain the novel reaction product in a concentration ranging from about 0.1 to 30 weight percent. A preferred concentration range for the additive is from about 1 to 15 weight percent based on the total weight of the oil composition.

Oil concentrates of the additive may contain from about 1 to 50 weight percent of the additive reaction product in a carrier or diluent oil of lubricating oil viscosity.

The novel reaction product of the reaction may be employed in lubricating oil compositions together with conventional lubricant additives. Such additives may include additional dispersants, detergents, anti-oxidants, pour point depressants, anti-wear agents and the like.

The dispersant propertities of the additive-containing oil are determined in the Bench Sludge Test. Dispersancy of a lubricating oil is determined relative to three references which are the results from three standards blends tested with the unknown. The test additives were blended into a formulated oil containing no dispersant. The additive reaction product was employed in the oil at a concentration of 12.0 weight percent polymer solution.

The product prepared in these examples were blended into formulated oil not containing dispersant to form 1.20 weight percent polymer solutions. These blends were tested for dispersancy in the above test and the results of such test are provided below in Table I. In this test dispersancy is compared to that of three reference oils which are tested along with the experimental samples. In Table I below, dispersant effectiveness is characterized as pass (P), marginal pass (MP), or fail (F).

TABLE I

| BENCH SLUDGE TEST | |
|---|---|
| Additive | Result |
| Ethylene-propylene copolymer | Fail |
| Example 2 | Pass |
| Example 3 | Pass |
| Example 4 | Pass |
| Example 5 | Pass |
| Example 6 | Marginal Pass |
| Example 7 | Pass |
| Commercial DOCP | Pass |

The results from this test show that the subject of this invention gave consistently better dispersancy performance then the corresponding unmodified ethylene-propylene copolymer.

The antioxidant properties of the novel reaction product in a lubricating oil were determined in the bench oxidation test. In this test, 1.5 weight percent of the additive reaction product is blended into the solvent neutral oil (S.U.S. at 100° F. of 130). The mixture is continuously stirred while being heated accompanied by bubbling with air.

Samples are periodically withdrawn for analysis by Differential Infrared Absorption (DIR) to observe changes in the intensity of the carbonyl vibration band at 1710 cm−1. A low carbonyl vibration band intensity indicates higher thermal-oxidative stability of the sample. Below, Table II summarizes the results of BOT testing.

TABLE II

BENCH OXIDATION TEST

| Additive | Result |
|---|---|
| Ethylene-propylene copolymer | <100 |
| Example 2 | 4.7 |
| Example 3 | 4.1 |
| Example 4 | 4.5 |
| Example 5 | 6.3 |
| Example 6 | 4.1 |
| Example 7 | 2.2 |
| Commercial NVP grafted DOCP | 15 |

The test data in Table II demonstrate that substantial anti-oxidative properties result when ethylene-propylene copolymer or terpolymers are modified with substituted 1,3,4-thiadiazole.

The novel reaction product of this invention was also tested for its effectiveness as an anti-wear additive in formulated lubricating compositions.

The lubricating oil composition used in this testing is illustrated below in Table III.

TABLE III

| Component | Parts By Wgt |
|---|---|
| Solvent Neutral Oil A | 83.50 |
| Solvent Neutral Oil B | 5.00 |
| Product | 11.50 |

Oil A has a Sp. Gr. at 60/60 F of 0.858–0.868; Vis. @11 F is 123–133 cPs; Pour Point is 0 F. Oil B has a Sp. Gr. at 60/60 F of 0.871–0.88; Vis. @100 F is 325–350 cPs; Pour Point is 10 F.

Anti-wear properties of the novel additive were evaluated using the Four Ball Wear Test, ASTM Test No. MS 82-79. In this test the oil is heated to 167° F. for 60 minutes at 600 RPM's under a 40 kg load. Anti-wear properties are assessed on the basis of scar diameters of standardized components. Reference oil samples containing unmodified ethylene-propylene copolymers or ethylene-propylene terpolymers are first evaluated so that a comparison with the chemically modified polymer may be performed.

To assess wear resistance of ethylene-propylene copolymers containing grafted modified 1,3,4-thiadiazole, this experimental material was subjected to the Four Ball Wear Test. An 11.5 weight percent of the modified ethylene-propylene copolymer was subjected to a 40 kg weight at 6000 RPM's at 167 F for 60 minutes. Results of Four Ball Wear Testing are provided below in Table IV.

TABLE IV

FOUR BALL WEAR TEST

| Material | Average Scar Diameter (mm) |
|---|---|
| Unmodified Ethylene-Propylene Copolymer | 0.75 |
| Material from Example 2. | 0.34 |
| Material from Example 3. | 0.42 |
| Material from Example 4. | 0.52 |
| Material from Example 5. | 0.46 |
| Material from Example 6. | 0.40 |
| Material from Example 7. | 0.41 |

It is immediately evident that by chemically incorporating modified 1,3,4-thiadiazole onto an ethylene-propylene copolymer, wear-resistance is enhanced by approximately 60%.

What is claimed is:

1. An antiwear, antioxidancy dispersant, lubricant additive composition prepared by the steps comprising:

(a) reacting a polymer prepared from ethylene and at least one ($C_3$–$C_{10}$) alpha-monoolefin and, optionally, a polyene selected from non-conjugated dienes and trienes comprising from about 15 to 80 mole percent of ethylene, from about 20 to 85 mole percent of said ($C_3$–$C_{10}$) alpha-monoolefin and from about 0 to 15 mole percent of said polyene, said polymer having a number average molecular weight ranging from about 5,000 to about 500,000, said polymer being reacted with at least one olefinic epoxide acylating agent at a mole ratio of polymer to olefinic expoxide of about 10.5:1 at a temperature of about 160° C. for about 1.75 to 2.0 hours to form a reaction intermediate having an epoxide function within its structure; and (b) reacting said reaction intermediate with each of the following substituted thiadiazoles at a mole rati of 20:0.15 at a temperature of about 155° C. for about 2.0 hours;

(i) a modified 1,3,4-thiadiazole containing a substituted phenol represented by the formula:

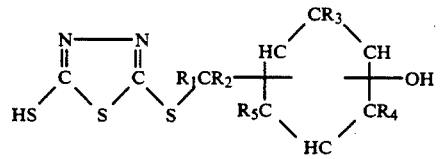

wherein $R_1$, $R_2$ and $R_3$ are each hydrogen or a ($C_1$–$C_{10}$) alkyl radical; and $R_4$ and $R_5$ are each a ($C_1$–$C_{10}$) alkyl radical;

(ii) a modified 1,3,4-thiadiazole containing a substituted diaryl amine represented by the formula:

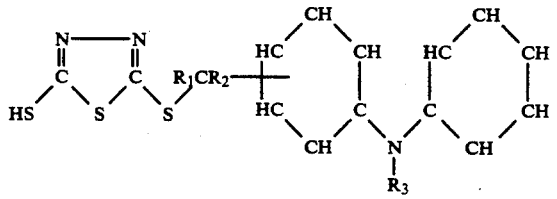

wherein $R_1$, $R_2$, and $R_3$ are each hydrogen or a ($C_1$–$C_{10}$) alkyl radical; and (iii) Reacting said reaction intermediate in (A) with modified 1,3,4-thiadiazole containing substituted phenothiazole represented by the formula:

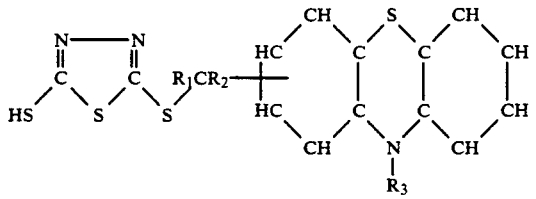

wherein $R_1$, $R_2$, and $R_3$ are each $H_2$ or a ($C_1$–$C_{10}$) alkyl group, to form said lubricant additive; and (d) isolating and recovering the product lubricant additive composition.

2. A composition according to claim 1 in which said polymer has an average molecular weight ranging from about 25,000 to about 250,000.

3. A composition according to claim 1 in which said polymer has an average molecular weight ranging from about 50, 000 to about 150,000.

4. A composition according to claim in which said olefinic epoxide acid acylating agent is glycidyl methacrylate.

5. A composition according to claim 1 in which said modified 1,3,4-thiadiazole containing substituted phenol is 2-mercapto-5-mercaptomethyl-[3-(4-hydroxylmethyl-2,6-di-t-butyl-phenol)ether]-1,3-4-thiadiazole.

6. A composition according to claim 1 in which said modified 1,3,4-thiadiazole containing substituted diaryl amine is 2-mercapto- 5-mercaptomethyl-[4(1,1'-diphenylamine)ether]-1,3,4-thiadiazole.

7. A composition according to claim 1 in which said modified 1,3,4-thiadiazole containing substituted phenothiazine is 2-mercapto-5-mercato-i-propyl-[1-(phenothiazine)ether]-1,3,4-thiadiazole.

8. A lubricating oil composition comprising a major amount of an oil of lubricating viscosity and a minor amount, effective to impart viscosity index dispersancy, and anti-oxidant properties to said oil, of an additive composition prepared by the steps comprising:

(a) reacting a polymer prepared from ethylene and at least one ($C_3$–$C_{10}$) alpha-monoolefin and, optionally, a polyene selected from non-conjugated dienes and trienes comprising from about 15 to 80 mole percent of ethylene, about 20 to 85 mole percent of said ($C_3$–$C_{10}$) alpha-monoolefin and from about 0 to 15 mole percent of said polyene, said polymer having an average molecular weight ranging from about 5,000 to 500,000, said polymer being reacted with at least one olefinic epoxide acylating agent at a mole ratio of intermediate to substituted thiadiazoles of about 10.5:1 at a temperature of about 160° C. for about 1.75 to 2.0 hours to form a reaction intermediate having an epoxide function within its structure; and (b) reacting said reaction intermediate with each of the following substituted thiadiazoles at a mole ratio of 20:15 at a temperature of about 155° C. for about 2.0 hours (i) a modified 1,3,4-thiadiazole containing a substituted phenol represented by the formula:

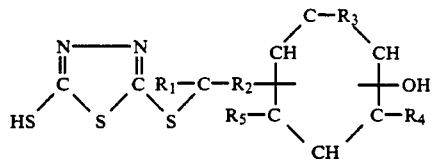

wherein $R_1$, $R_2$ and $R_3$ are each hdyrogen or a ($C_1$–$C_{10}$) alkyl radical; and $R_4$ and $R_5$ are each a ($C_1$–$C_{10}$) alkyl radical;

(ii) a modified 1,3,4-thiadiazole containing a substituted diaryl amine represented by the formula:

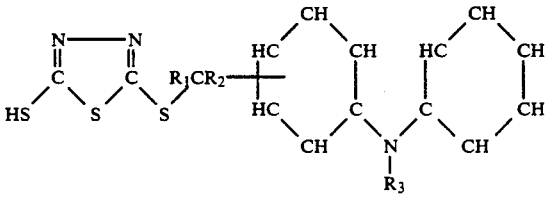

wherein $R_1$ $R_2$ and $R_3$ are each hydrogen or a ($C_1$–$C_{10}$) alkyl radical; and (iii) a modified 1,3,4-thiadiazole containing a substituted phenothiazine represented by the formula:

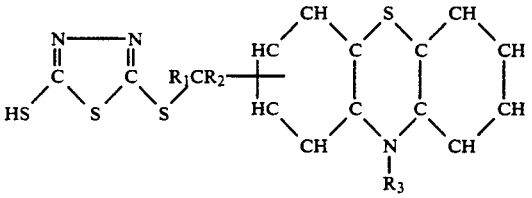

wherein $R_1$, $R_2$, and $R_3$ are each hydrogen or a ($C_1$–$C_{10}$) alkyl radical, to form said lubricant additive composition; and (c) isolating and recovering the product lubricant additive composition.

9. A lubricating oil composition according to claim 8 in which said modified 1,3,4-thiazole containing substituted phenol is 2-mercapto-5-mercaptomethyl-[3-(4-hydroxylmethyl-2,6,-di-t-butyl-phenol)ether]-1,3,4-thiadiazole.

10. A lubricating oil composition according to claim 8 in which said modified 1,3,4-thiadiazole containing diarylamine is 2-mercapto-5-mercaptomethyl-[4-(1, 1'-diphenylamine)ether]-1,3, 4-thiadiazole.

11. A lubricating oil composition according to claim 8 in which said modified 1,3,4-thiadiazole containing phenothiazine is 2-mercapto-5-mercapto-i-propyl-[1-(phenothiazine)ether]-thiadiazole.

* * * * *